US010090101B2

(12) United States Patent
McCloskey

(10) Patent No.: US 10,090,101 B2
(45) Date of Patent: Oct. 2, 2018

(54) EXPANDABLE AND FLEXIBLE TERMINAL ASSEMBLY

(71) Applicant: Amran Inc., Sugar Land, TX (US)

(72) Inventor: Scott McCloskey, Missouri City, TX (US)

( * ) Notice: Subject to any disclaimer, the term of this patent is extended or adjusted under 35 U.S.C. 154(b) by 129 days.

(21) Appl. No.: 15/142,662

(22) Filed: Apr. 29, 2016

(65) Prior Publication Data

US 2017/0316877 A1 Nov. 2, 2017

(51) Int. Cl.

| | |
|---|---|
| ***H01F 38/20*** | (2006.01) |
| ***H01F 27/29*** | (2006.01) |
| ***H01F 17/04*** | (2006.01) |
| ***H01F 38/30*** | (2006.01) |

(52) U.S. Cl.
CPC ..... *H01F 38/30* (2013.01)

(58) Field of Classification Search
USPC ..... 336/174, 175, 221, 225, 192
See application file for complete search history.

(56) References Cited

U.S. PATENT DOCUMENTS 3,727,171 A * 4/1973 Coles ..... H01R 4/34 439/110
4,551,700 A * 11/1985 Waldemar ..... H01F 27/29 174/138 E
6,307,445 B1 * 10/2001 Makinen ..... H01R 29/00 333/1
2010/0237977 A1 * 9/2010 Ikezawa ..... H01F 27/2847 336/232
2011/0068653 A1 * 3/2011 Agematsu ..... H01F 5/04 310/179
2012/0154094 A1 * 6/2012 Goertz ..... H01F 27/29 336/192
2013/0113590 A1 * 5/2013 Yu ..... H01F 17/062 336/192
2014/0001976 A1 * 1/2014 Park ..... H01F 5/04 315/276

* cited by examiner

*Primary Examiner* — Elvin G Enad
*Assistant Examiner* — Kazi Hossain
(74) *Attorney, Agent, or Firm* — Korney, McWilliams & Davis, PLLC; William C. Yarbrough

(57) ABSTRACT

The present invention provides an expandable and flexible apparatus that can be installed on a device including but not limited to a bushing current transformer (BCT), a control power transformer or a toroidal power transformer. Such an apparatus provides at least one connection point on the device that it is installed on. The apparatus comprises a terminal, a terminal plate, a terminal plate expansion strip or a combination thereof. The apparatus is novel because it has an expandable connection that allows for many terminals to link and be positioned in desired configurations and distances, a linking system that makes the apparatus flexible and allows it to follow the contours of the device, and an anti-rotational provision that holds the terminal in position while the user is connecting wires to the apparatus.

19 Claims, 7 Drawing Sheets

EXPANDABLE AND FLEXIBLE TERMINAL ASSEMBLY

BACKGROUND OF THE INVENTION

Field of the Invention

The present invention generally relates to an apparatus that is flexible, expandable and can be installed on devices in a manner to allow connection of the wires to the devices on which it is installed. More specifically, the present invention is drawn to an apparatus that can be installed on a device such as a bushing current transformer (BCT), is low profile, flexible and expandable, and provides at least one connection point for wires on the BCT.

Description of the Related Art

Conventional connection points or terminals on devices such as BCTs are nothing more than ring lugs that are bent at 90 degrees and placed on the outer diameter of the BCTs. However, these terminals or connection points have several disadvantages. For instance, the bending of the ring lug terminals at 90 degrees creates a weak point on the terminal. As a result, there is a greater likelihood of the customer breaking the terminal during installation. Further, the ring lug requires the user to use a nut and bolt to secure the wire connections. Due to this, the user has to use two wrenches, one wrench on the bolt and the other on the nut, to secure their connections in order to prevent breaking the terminals. This limits the spacing between the terminals to the size of the bolts and nuts. Still further, the ring terminals are thin and can be damaged in transit or during installation. Additionally, since these terminals are bent, the user has to straighten them out which can ultimately break the terminal. Further yet, the ring lugs extend out significantly from the outer diameter of the BCT.

Thus, there is a long-felt but significant and un-met need in the art for an apparatus that is strong, low profile, expandable, flexible, follows the contours of a device, provides at least one connection point on a device that it is installed on or a combination thereof. The present invention satisfies this long standing need in the art.

SUMMARY OF THE INVENTION

In a preferred embodiment, the present invention is directed to an apparatus that provides at least one connection point on a device.

In another embodiment, such an apparatus comprises at least one terminal that provides a connection point for wires to the device; a terminal plate to hold the terminal in place; at least one terminal plate expansion strip to link one terminal plate with another terminal plate; or a combination thereof.

In yet another embodiment, the terminal further comprises at least one female insert to connect the wires to the device, wherein said female insert is threaded; and at least one screw. In yet another embodiment, the terminal is made of electrically conductive metal or alloy, where the electrically conductive metal or alloy is brass, copper, aluminum or a combination thereof. In another embodiment, the terminal is square shaped on the bottom and has a circular groove cut of the terminal. In yet another embodiment, the square shaped terminal has a side of about 0.375 inches. In still yet another embodiment, the groove has a diameter of about 0.27 inches and has a height of about 1.5 inches. In further yet another embodiment, the height of the terminal is about 0.3 inches to about 1.5 inches. In yet another embodiment, the terminal has a threaded stud or a threaded hole.

In further yet another embodiment, the terminal plate further comprises a front side and a back side, wherein the back side of the terminal plate comprises at least one groove to allow placement of the terminal plate expansion strip. In still yet another embodiment, the placement of the terminal plate expansion strip in the groove provides low profile, expandable, and flexible connection points on the device, allows the apparatus to follow the contour of the device that it is installed on, allows the terminal to be spaced and positioned as desired or a combination thereof. In another embodiment, the groove has the size range from about 0.003 inches to about 0.125 inches. In yet another embodiment, the terminal plate has a dimension ranging from about 0.25 inches×0.5 inches×0.36 inches to about 0.75 inches×1.5 inches×0.36 inches. In still yet another embodiment, the terminal plate comprises a half circle with a diameter of about 0.27 inches placed along the length of the terminal plate, where the circle has a depth of about 0.125 inches. In further yet another embodiment, the terminal plate is made of a non-conductive material, where the non-conductive material is plastic, acrylonitrile butadiene styrene (ABS), nylon glass fiber reinforced polyamid (PAG), or fiberglass. In still yet another embodiment, the terminal plate comprises a single piece or multiple pieces, where the piece is configured in a manner to hold the terminal in place. In another embodiment, the terminal plate prevents the terminal from rotating while connecting wires to the terminal.

In yet another embodiment, the terminal plate expansion strip is made of a non-conductive material, where the non-conductive material is press board, plastic, mylar, nomex, fiber board, rubber, fiberglass, glastic, or other polyester. In another embodiment, the terminal plate expansion strip is not more than about 0.073 inches thick. In yet another embodiment, the device may include but is not limited to a BCT, control power transformer, or toroidal power transformer.

DETAILED DESCRIPTION OF THE INVENTION

The present invention is directed to an apparatus that provides flexible, low profile and expandable connection points on a device for connecting wires, where the device includes but is not limited to a bushing current transformer (BCT), a control power transformer or a toroidal power transformer.

Figure 1A:
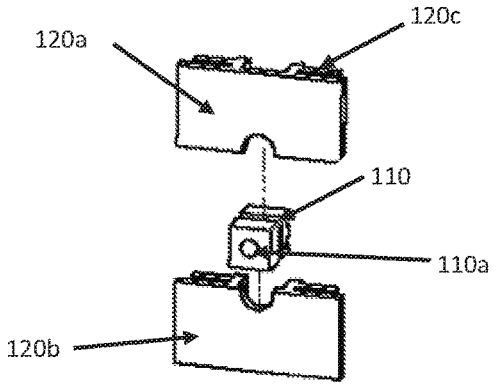
FIGS. 1A-1C show the cross-sectional front views of the apparatus described in the present invention.
Figure 1B:
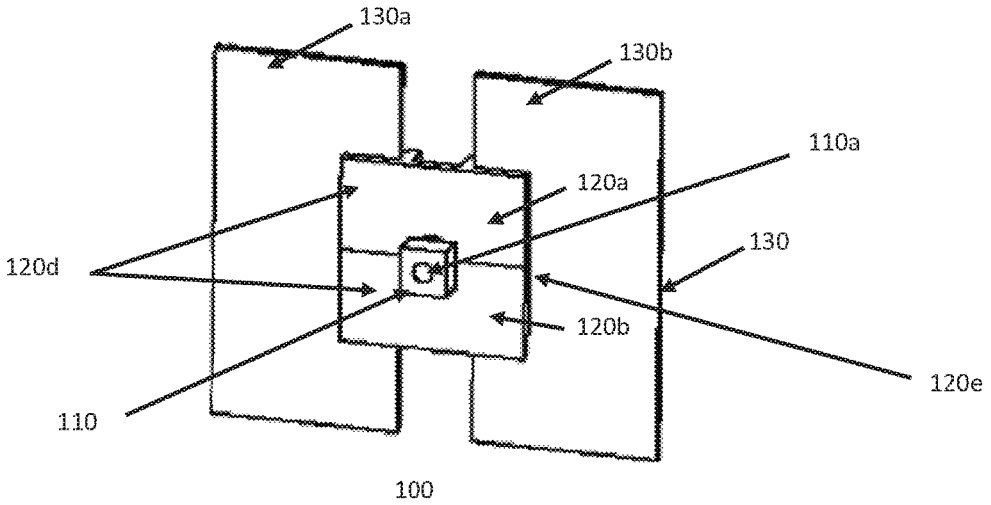
Figure 1C:
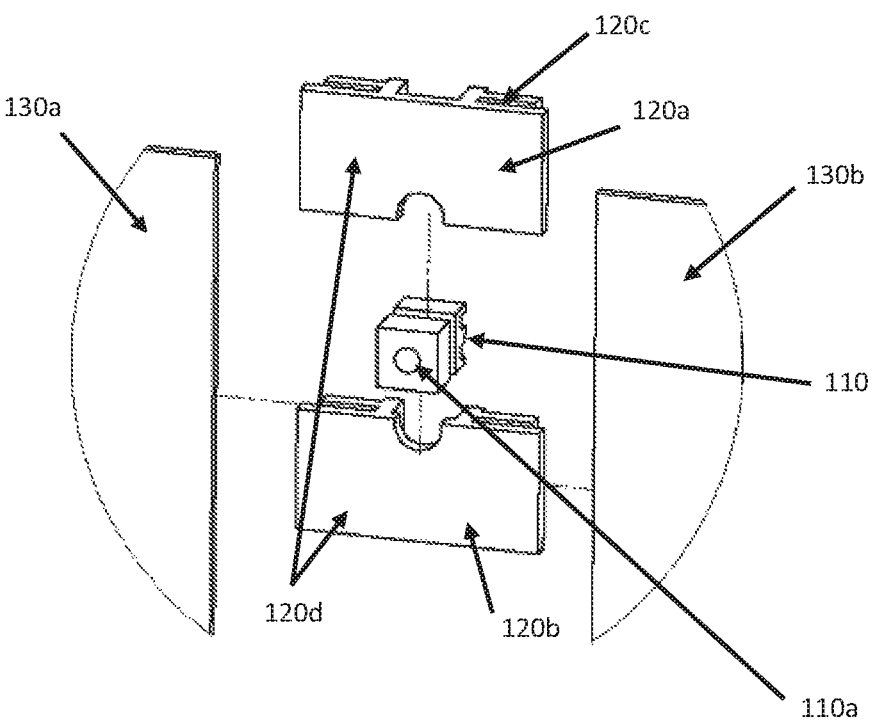

FIGS. 1A-1C, 2-4, 5A-5C, 6, and 7A-7D show examples of the preferred embodiments of the present invention. In FIGS. 1A, 1B and 1C, the apparatus 100 described herein comprises a terminal 110 that provides a connection point for wires on the device on which it is installed. The terminal 110 comprises at least one female insert with at least one screw, where the female insert is used to connect the wires to the device. The female insert may be threaded. The apparatus 100 further comprises a terminal plate 120 to hold the terminal 110 in place so that the terminal 110 does not rotate or move inward or outward while the user is connecting wires to the terminal 110. The terminal plate 120 is an expandable, custom molded plastic component of the apparatus 100. The terminal plate 120 may be a single piece or multiple pieces, where the piece(s) is configured in a manner to hold the terminal 110 in place. FIGS. 1A-1B show examples of the terminal plate 120 that comprises two pieces, namely 120*a* and 120*b*. These pieces are aligned in a symmetrical manner as shown in these figures. Further, the ends of the pieces 120*a* and 120*b* that touch the terminal 110 are configured in a manner to hold the terminal 110 in place. The terminal 110 is made of an electrically conductive metal or alloy including but not limited to brass, copper, aluminum or a combination thereof. The terminal 110 can have any dimension as long as it has a bottom that is square shaped and has a circular groove cut along the height of the terminal 110 so that the terminal 110 fits into the terminal plate 120. The terminal 110 could have a threaded stud or a round top instead of a square top and a threaded hole. In a preferred embodiment, the square shaped terminal 110 has a side of about 0.375 inches. In other embodiments, the square shaped terminal may have a side which is less than 0.375 inches, or greater than 0.375 inches. Additionally, the terminal 110 has a circular groove 110*a* cut along the height of the terminal 110. In another embodiment, the groove 110*a* has a diameter of about 0.27 inches and a height of about 0.125 inches. In other embodiments, the groove 110*a* may have a diameter less than 0.27 inches or greater than 0.27 inches, and a height of less than 0.125 inches or greater than 0.125 inches. In a preferred embodiment, the height of the terminal 110 is about 0.3 inches to about 1.5 inches. In other embodiments, the height of the terminal 110 may be less than or greater than 0.3 inches to 1.5 inches.

Figure 2:
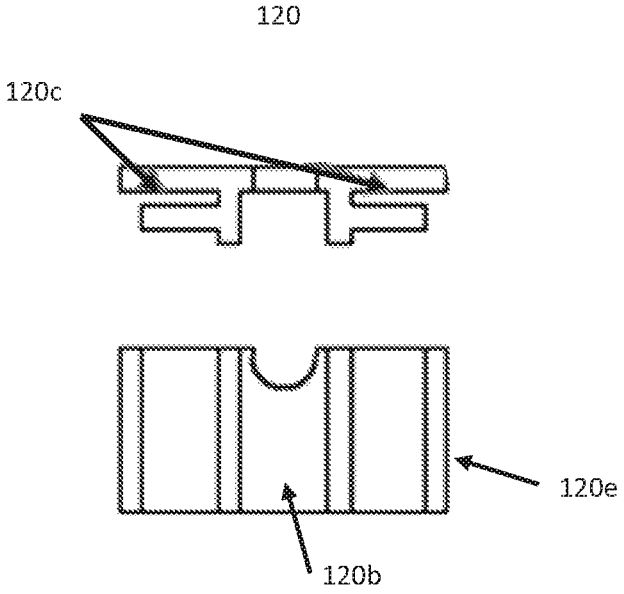
FIG. 2 shows a cross sectional front and back view of the lower half of the expandable terminal plate, which is one of the components of the apparatus.

The terminal plate 120 is made of a non-conductive material including but not limited to plastic, acrylonitrile butadiene styrene (ABS), nylon glass fiber reinforced polyamide (PAG), or fiberglass. In a preferred embodiment, the size of the groove on the back side of the terminal plate 120 where the terminal plate expansion strip 130 is placed is about 0.003 inches to about 0.125 inches. In other embodiments, the size of the groove on the back side of the terminal plate 120 may be less than or greater than 0.003 inches to 0.125 inches. FIG. 2 shows the front and back view of the lower half of the expandable terminal plate 120. The terminal plate 120 has a front side 120*d* and a back side 120*e*. As shown in this figure, the back side 120*e* of terminal plate 120 comprises at least one groove 120*c* that allow it to be linked to multiple terminal plates holding the terminals by the use of another component of the apparatus known as the terminal plate expansion strip 130. In a preferred embodiment, the terminal plate 120 has dimensions ranging from about 0.25 inches×0.5 inches×0.36 inches to about 0.75 inches×1.5 inches×0.36 inches. In other embodiments, the dimensions may also be less than or greater than 0.25 inches×0.5 inches×0.36 inches to 0.75 inches×1.5 inches×0.36 inches. In a preferred embodiment, the terminal plate 120 may comprise a half circle with a diameter of about 0.27 inches placed anywhere along the length of the terminal plate, where the circle has a depth of about 0.125 inches. In other embodiments, the diameter may be less than or greater than 0.27 inches and the depth of the circle may be less than or greater than 0.125 inches.

As shown in FIGS. 1A and 1B, the terminal plate expansion strip 130 can be placed in the grooves located on the back side 120*e* of terminal plate 120 and connects one terminal plate 120 to another terminal plate 120. The terminal plate expansion strip 130 can be made of a variety of sizes and materials, which allows the terminals to be spaced and positioned as desired or required by the user. The terminal plate expansion strip 130 is made of a non-conductive material including but not limited to press board, plastic, mylar, nomex, fiber board, rubber, fiber glass, glastic or any other polyester. In a preferred embodiment, the terminal plate expansion strip 130 cannot be thicker than about 0.073 inches. In other embodiments, the terminal plate expansion strip 130 may be less than 0.073 inches. If the terminal plate expansion strip 130 is less than 0.073 inches, it can be stacked together to get the desired thickness.

Figure 3:
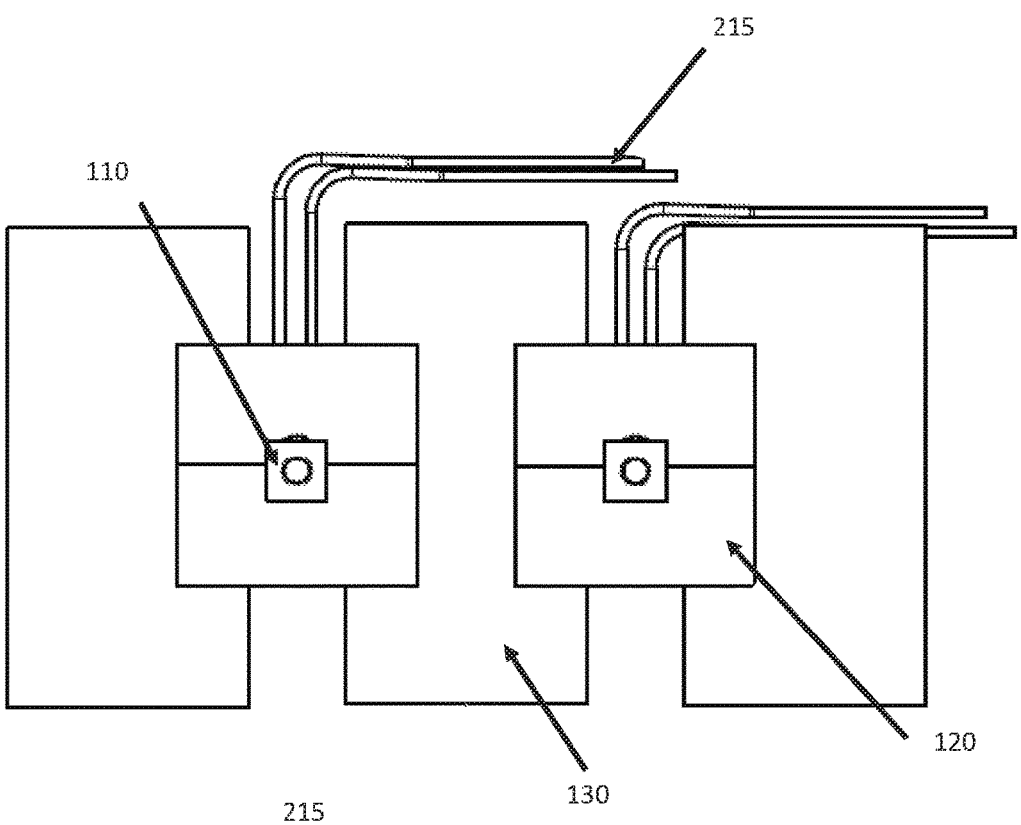
FIG. 3 shows the frontal view of the apparatus that comprises the expandable terminal plate, the terminal and the terminal plate expansion strip.
Figure 4:
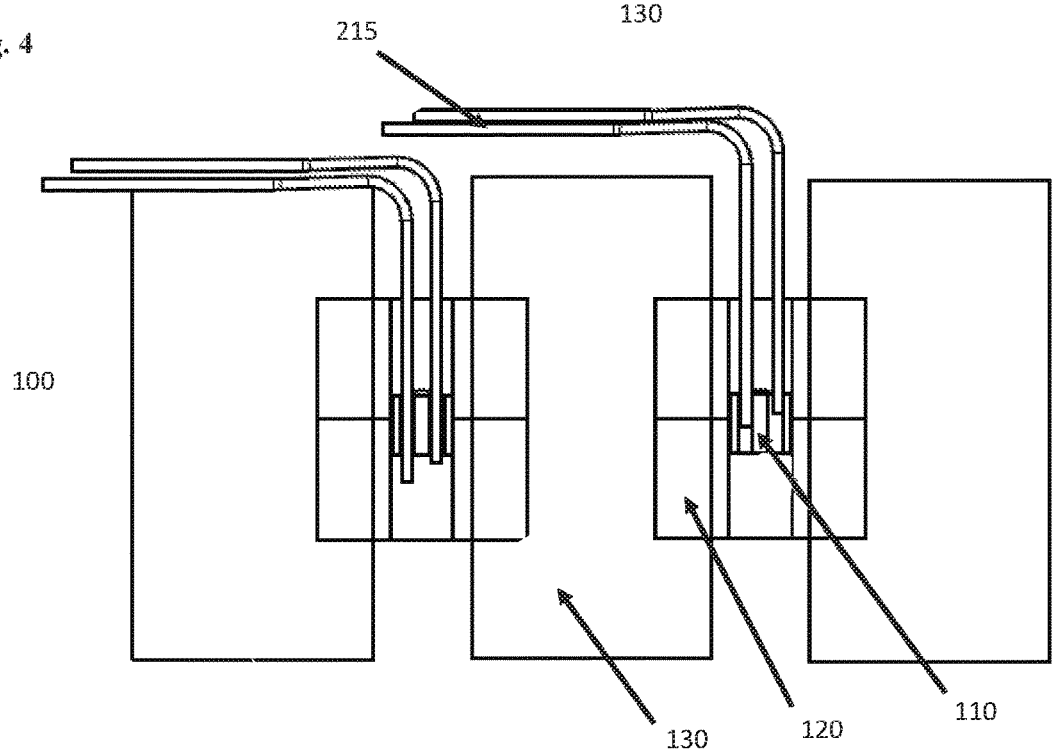
FIG. 4 shows the posterior view of the apparatus where the terminals are connected to the magnetic wire of the BCT.
Figure 5A:
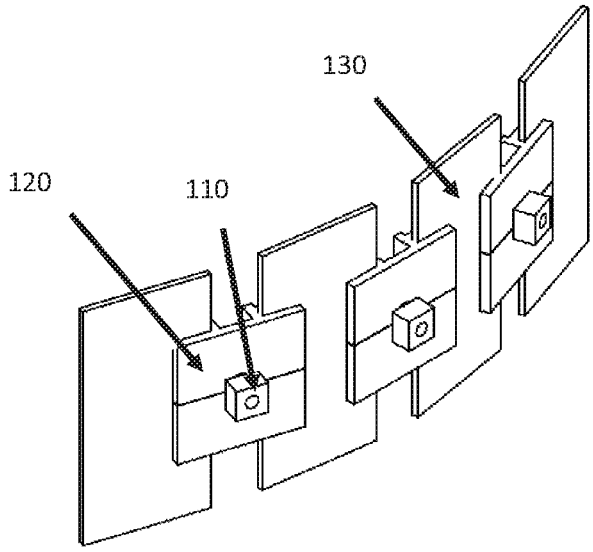
FIGS. 5A-5C show the flexible nature of the apparatus.
Figure 5B:
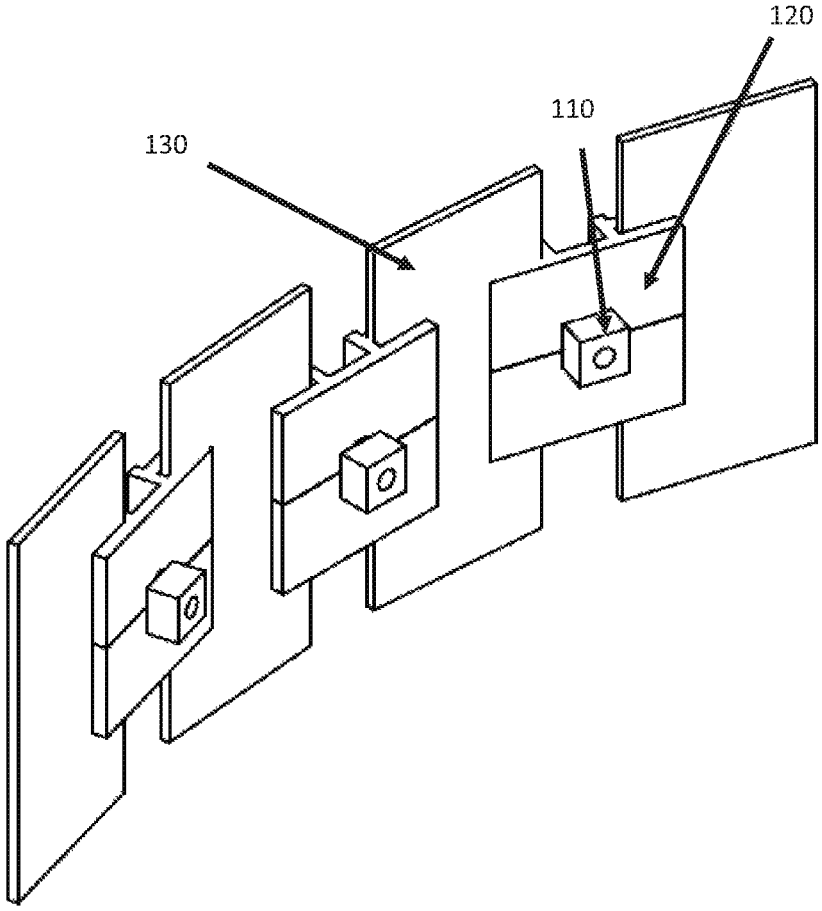
Figure 5C:
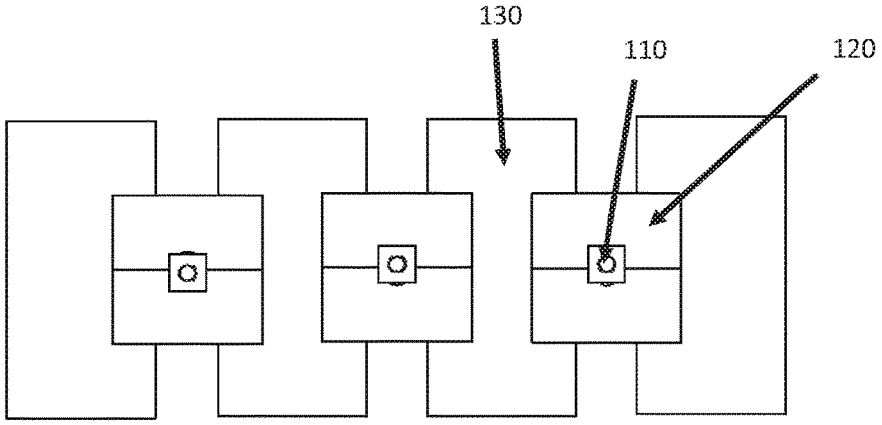

A user can expand the apparatus 100 from two terminals to as many as he desires by using multiple pieces of the terminal plate expansion strip 130 as shown in FIG. 3. FIG. 4 shows the backside of the apparatus where the terminal 110 is connected to the magnetic wire 215 of the BCT 210. The magnetic wire 215 is connected to the terminal 110 by means including but not limited to soldering. The terminal plate expansion strip 130 also allows the linked terminals to be flexible so that they can follow the contours of the device including but is not limited to BCT that they are installed on as shown in FIGS. 5A-5C. The terminal 110 can be used to connect to any type of wire including but not limited to magnetic wire.

Figure 6:
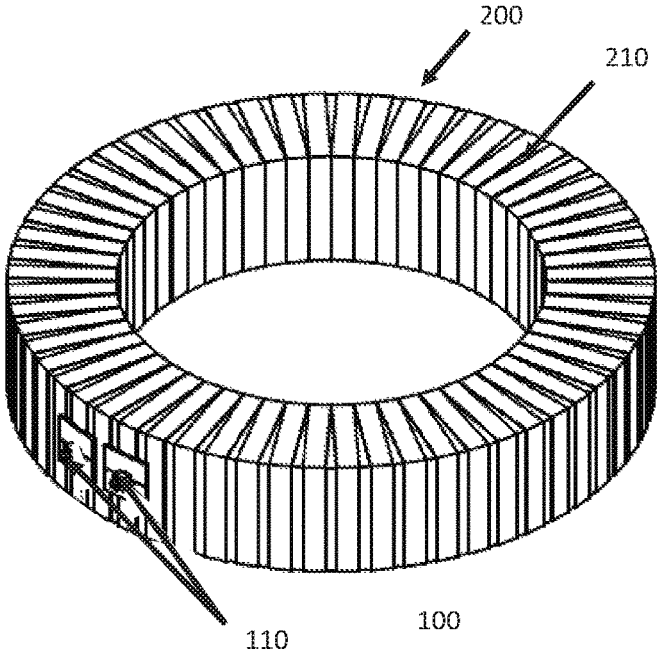
FIG. 6 shows the apparatus mounted on a BCT.
Figure 7A:
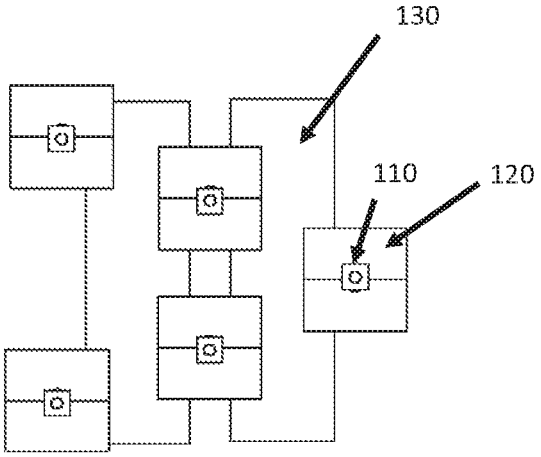
FIGS. 7A-7D show the different positions of the apparatus.
Figure 7B:
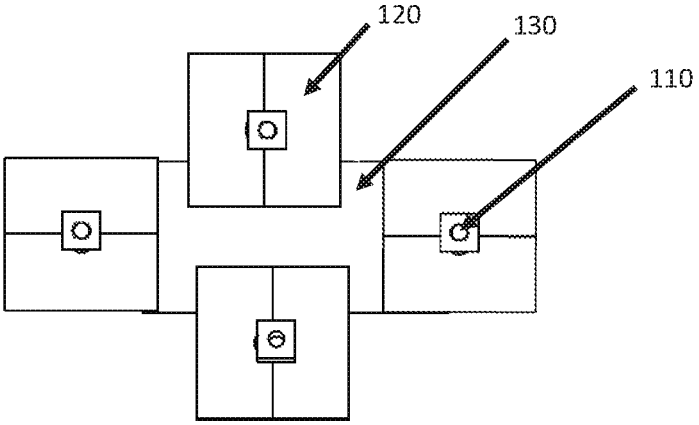
Figure 7C:
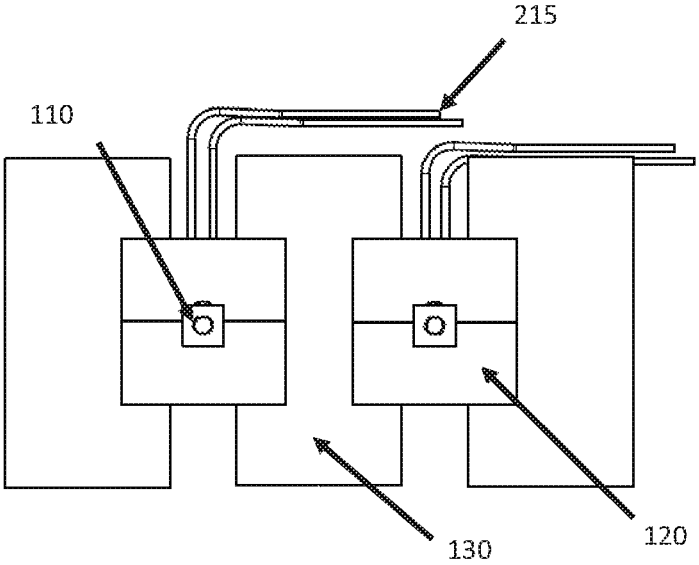
Figure 7D:
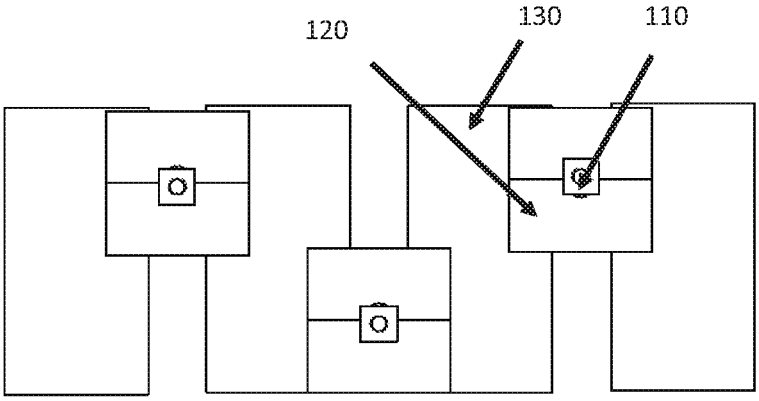

FIG. 6 shows the apparatus 100 as it is installed on a BCT 210. The apparatus 100 may be installed on the BCT and secured by any means known in the art including but not limited to soldering the apparatus 100 to the wire 215 of the BCT 210. Once secured on the BCT 210, the apparatus is insulated or covered with any suitable insulating material, including but not limited to, a Mylar tape so that only the terminal 110 is exposed. As described herein, the terminal plate expansion strip 130 can be used to align the terminals in several different positions as shown in FIGS. 7A-7D.

The apparatus 100 described in the present invention provides a low profile, expandable and flexible connection point(s) on any device that it is installed on. The apparatus 100 has novel features that comprise: (1) an expandable connection that allows for multiple terminal plate 120 to be linked together and positioned in many different configurations and at any distances from each other; (2) a linking system comprising terminal plate expansion strip 130 that makes the apparatus 100 flexible so that it can follow the contours of the device such as the BCT and provides a lower profile connection point for the user; and (3) an anti-rotational provision in the terminal plate 120 that keeps the terminal 110 from rotating when the user is connecting wires to the terminal, thus preventing damage to the device such as BCT.

Additionally, the design of the apparatus 100 is such that the user requires one tool (screw driver or wrench) to tighten the connection and there are no limitations on how close the terminal 110 is spaced apart. Since the terminal 110 is held in a terminal plate 120, there is lesser likelihood of the terminals bending in anyway. The lower profile design of the apparatus 100 increases the clearances of the BCT 210 inside the housing that the user places the device such as the BCT 210 in.

While a preferred shape, size or dimension of the terminal 110, terminal plate 120 and terminal plate expansion strip 130 are shown in the figures described herein, it is to be understood that these components of the apparatus 100 can be manufactured to have any suitable shape, size or dimension as needed or required. Similarly, while the preferred material to manufacture the terminal 110, terminal plate 120 and terminal plate expansion strip 130 is described herein, it is to be understood that these components of the apparatus 100 can be manufactured with any suitable material as needed or required.

As used herein, the term "apparatus" refers to a device or a system that has more than one component. For instance, the apparatus described herein comprises a terminal 110, a terminal plate 120, terminal plate expansion strip 130 or a combination thereof.

As used herein, the term "terminal" refers to any means that is used to connect the wires of the device. For instance, the terminal 110 in the apparatus 100 provides a connection point for the wires of the device, for instance, the BCT 210, that it is installed on.

As used herein, the term "terminal plate" refers to any means that is used to hold the terminal in its place. For instance, the terminal plate 120 holds the terminal 110 in place and prevents it from rotating when the user is connecting wires to the terminal 110.

As used herein, the term "configured" is used to describe a design or adaptation to serve a specific purpose. For instance, when the terminal plate 120 comprises two pieces, the ends of the piece 120*a* and piece 120*b* of the terminal plate 120 that touch the terminal 110 are designed or shaped in such a manner that it can hold the terminal 110 in place for the user to connect wires.

As used herein, the term "groove" is used to describe a long, narrow cut or indentation in a surface and includes but s not limited to a cut, a furrow, a trench, or similar depression.

As used herein, the term "terminal plate expansion strip" refers to any means that is used to link multiple terminal plates, allows for terminals to be spaced and positioned or both.

As used herein, the term "install" used herein refers to a preferred mechanism for attaching, affixing or supporting the apparatus 100 of the present invention on the device including but not limited to a BCT, a control power transformer, or a toroidal power transformer.

As used herein, the terms "solder" and "soldering" used herein refers to a preferred mechanism for attaching, affixing or supporting the magnet wire 215 of the device, for instance BCT 210.

The foregoing descriptions of the embodiments of the present invention have been presented for purposes of illustration and description. They are not intended to be exhaustive or to limit the present invention to the precise forms disclosed. The exemplary embodiments were chosen and described in order to best explain the principles of the present invention and its practical application, to thereby enable others skilled in the art to best utilize the present invention.

What is claimed is:

1. An apparatus in the form of an expandable terminal plate assembly that provides at least one connection point on a bushing current transformer, comprising at least one terminal to a plurality of terminals that provide at least one to a plurality of connection points for wires to said bushing current transformer;

a terminal plate to hold said terminal to a plurality of terminals in place;

at least one terminal plate expansion strip to link one terminal plate with another terminal plate; or a combination thereof.

2. The apparatus of claim 1, wherein said terminal further comprises:

at Least one female insert to connect the wires to the device, wherein said female insert is threaded; and at least one screw.

3. The apparatus of claim 1, wherein said terminal is made of electrically conductive metal or alloy, said electrically conductive metal or alloy is brass, copper, aluminum or a combination thereof.

4. The apparatus of claim 1, wherein said terminal is designed to express receiving grooves circumferentially on the top, bottom, and sides running parallel to terminal face and are made to accept the said terminal plate for positional placement and securing of said terminal against undesirable movement.

5. The apparatus of claim 4, wherein the square shaped terminal has a side of about 0.375 inches.

6. The apparatus of claim 4, wherein said groove has a diameter of about 0.27 inches and has a height of about 0.125 inches.

7. The apparatus of claim 4, wherein the height of the terminal is about 0.3 inches to about 1.5 inches.

8. The apparatus of claim 1, wherein said terminal has a threaded stud or a threaded hole.

9. The apparatus of claim 4, wherein said terminal plate further comprises:

a front side;

a back side, wherein the back side of the terminal plate comprises at least one grooved area to allow placement of the terminal plate expansion strip; and a centrally disposed recess for placement into said receiving grooves of a terminal.

10. The apparatus of claim 9, wherein said placement of the terminal plate expansion strip in the accepting terminal plate groove provides for low profile, expandable and flexible connection points on the bushing current transformer at varying points and distances, allows the apparatus to follow the contour of the bushing current transformer on which it is installed, and allows said terminal or plurality of terminals to be spaced and positioned and configured, symmetrically and asymmetrically, in series or a combination thereof as desired.

11. The apparatus of claim 9, wherein the groove has a size range from about 0.003 inches to about 0.125 inches.

12. The apparatus of claim 1, wherein said terminal plate has a dimension ranging from about 0.25 inches×0.5 inches×0.36 inches to about 0.75 inches×1.5 inches×0.36 inches.

13. The apparatus of claim 1, wherein said terminal plate comprises a half circle with a diameter of about 0.27 inches placed along the length of the terminal plate, wherein said circle has a depth of about 0.125 inches.

14. The apparatus of claim 1, wherein said terminal plate is made of a non-conductive material, said non-conductive material is plastic, acrylonitrile butadiene styrene (ABS), nylon glass fiber reinforced polyamid (PAG), or fiberglass.

15. The apparatus of claim 1, wherein said terminal plate comprises a single piece or multiple pieces, wherein said piece is configured in a manner to hold the terminal in place and allow for connection to a single piece or multiple piece terminal plate expansion strip.

16. The apparatus of claim 1, wherein the terminal plate and terminal plate expansion strips prevents the terminal from rotating during installation and transport.

17. The apparatus of claim 1, wherein said terminal plate expansion strip is made of a non-conductive material, said non-conductive material is press board, plastic, mylar, nomex, fiber board, rubber, fiberglass, plastic, or other polyester.

18. The apparatus of claim 1, wherein said terminal plate expansion strip is not more than about 0.073 inches thick.

19. The apparatus of claim 1, wherein the bushing current transformer may alternatively be a control power transformer or toroidal power transformer.

* * * * *